US005796210A

United States Patent [19]

Sakakibara et al.

[11] Patent Number: 5,796,210

[45] Date of Patent: Aug. 18, 1998

[54] CIRCULAR FLUORESCENT LAMP UNIT AND LIGHTING APPARATUS

[75] Inventors: Yuichi Sakakibara, Kanuma; Toshiharu Yagi; Akinori Yasuhara, both of Yokosuka; Ichiro Yamada, Yokohama, all of Japan

[73] Assignee: Toshiba Lighting & Technology Corporation, Tokyo, Japan

[21] Appl. No.: 811,538

[22] Filed: Mar. 4, 1997

[30] Foreign Application Priority Data

| | | | |
|---|---|---|---|
| Mar. 5, 1996 | [JP] | Japan | 8-047825 |
| Mar. 29, 1996 | [JP] | Japan | 8-075593 |
| Jan. 23, 1997 | [JP] | Japan | 9-009943 |

[51] Int. Cl.[6] ..... H01J 61/32; H01J 61/72

[52] U.S. Cl. ..... 313/493; 313/634; 362/216

[58] Field of Search ..... 313/493, 634, 313/635; 362/216, 222

[56] References Cited

U.S. PATENT DOCUMENTS

| | | | |
|---|---|---|---|
| 5,034,655 | 7/1991 | Murayama et al. . | |
| 5,463,540 | 10/1995 | Jones | 362/216 |
| 5,580,161 | 12/1996 | Vakil et al. | 362/216 |

FOREIGN PATENT DOCUMENTS 0 348 979 1/1990 European Pat. Off. .

OTHER PUBLICATIONS

Patent Abstracts of Japan, vol. 7, No. 247 (E–208), Nov. 2, 1983, JP 58 135564, Aug. 12, 1983.

Patent Abstracts of Japan, vol. 17, No. 415 (E–1407), Aug. 3, 1993, JP 05 082273, Apr. 2, 1993.

Patent Abstracts of Japan, vol. 17, No. 312 (M–1429), Jun. 15, 1993, JP 05 028803, Feb. 5, 1993.

Patent Abstracts of Japan, vol. 5, No. 153 (E–076), Sep. 26, 1981, JP 56 084859, Jul. 10, 1981.

Derwent Abstracts, AN 86–187276, JP 61–121 297, Jun. 9, 1986.

Patent Abstracts of Japan, vol. 18, No. 658 (E–1643), Dec. 13, 1994, JP 06 260295, Sep. 16, 1994.

Patent Abstracts of Japan, vol. 16, No. 554 (E–1293), Nov. 25, 1992, JP 04 212276, Aug. 3, 1992.

*Primary Examiner*—Nimeshkumar Patel

*Attorney, Agent, or Firm*—Oblon, Spivak, McClelland, Maier & Neustadt, P.C.

[57] ABSTRACT

A circular fluorescent lamp unit comprises a circular glass bulb having a circular outer diameter set within a range of 285 to 310 mm or thereabout. The circular fluorescent lamp unit comprises a tube outer diameter set within a range of 15 to 18 mm or thereabout and an inner surface onto which a fluorescent substance is applied. A discharge medium including a rare gas and a mercury is sealed up in the circular glass bulb. A pair of electrode means is fitted in both end portions of the circular glass bulb so as to be sealed therein. So that discharge occurs in the circular glass bulb by providing the pair of electrode means with a lamp power so that the circular glass bulb lights. The lamp power has a high frequency which is not less than 10 kHz and the lamp power is set within a range of 20 to 40 W or thereabout.

19 Claims, 9 Drawing Sheets

CIRCULAR FLUORESCENT LAMP UNIT AND LIGHTING APPARATUS

BACKGROUND OF THE INVENTION

1. Field of the Invention

The present invention relates to a circular fluorescent lamp unit and a lighting apparatus using this circular fluorescent lamp unit.

2. Description of the Prior Art

So far, the circular outer diameters of the glass bulbs of circular fluorescent lamp units commonly put to use has been, for example, 225 mm for 30 W, 299 mm for 32 W and 373 mm for 40 W, with the tube outer diameters of the respective glass bulbs being 29 mm.

Lighting apparatus using this circular fluorescent lamp unit is disclosed in Japanese Unexamined Patent Publication No. 4-212276. In the lighting apparatus, an apparatus body with a truncated cone configuration is provided on a lower surface of a top board. A socket and lamp holder are symmetrically provided so as to project downwardly from this apparatus body. A base of a circular fluorescent lamp unit is connected to this socket and a glass bulb portion opposed to the base of the circular fluorescent lamp unit is fitted in the lamp holder. The circular fluorescent lamp unit is arranged below the apparatus body. In this state, a high-frequency power is fed from a high-frequency lighting circuit such as an inverter lighting circuit built in the apparatus body to the circular fluorescent lamp unit so that the circular fluorescent lamp unit turns on a light.

Meanwhile, recently, in order to make the visual environments in a dwelling space comfortable, the tendency has been toward the size reduction and thickness reduction of goods for the interiors. The lighting apparatus is also a portion of the interior goods, and is increasingly required to reduce its thickness so that it is as if the ceiling surface seems to be high.

However, in the prior lighting apparatus which is of the type in that a circular fluorescent lamp unit is located within an apparatus body, it is difficult to reduce the thickness of whole apparatus including the circular fluorescent lamp unit.

More specifically, since the circular fluorescent lamp unit needs a lamp holder and a lamp socket for its connection and holding, a large space in the vertical directions is necessary. As a result of that, the thickness of the apparatus body is relatively enlarged. In addition, since the common circular fluorescent lamp unit has a tube outer diameter of 29 mm, limitation is imposed on fabricating a lighting apparatus with a desirable thickness.

SUMMARY OF THE INVENTION

The present invention is directed to overcome the foregoing problems. Accordingly, it is an object of the present invention to provide a circular fluorescent lamp unit the thickness of which is more reduced than that of the prior circular fluorescent lamp unit and a lighting apparatus using this circular fluorescent lamp unit the thickness of which is also more reduced than that of the prior lighting apparatus whereby the whole thickness reduction of the lighting apparatus having the circular lamp unit is realized while keeping the image of the prior apparatus in dimension so as to make the visual environments in a dwelling space comfortable in which the lighting apparatus of the present invention is set.

In addition, it is another object of the present invention to provide a circular fluorescent lamp unit, the lamp efficiency of which is improved than that of the prior circular fluorescent lamp unit while keeping the thickness thereof reduced.

In order to achieve the such objects, according to one aspect of the present invention, there is provided a circular fluorescent lamp unit comprising a circular glass bulb having a circular outer diameter set within a range of 285 to 310 mm or thereabout, a tube outer diameter set within a range of 15 to 18 mm or thereabout, and an inner surface onto which a fluorescent substance is applied; a discharge medium including a rare gas and a mercury sealed up in the circular glass bulb; and a pair of electrode means fitted in both end portions of the circular glass bulb so as to be sealed therein whereby discharge occurs in the circular glass bulb by providing the pair of electrode means with a lamp power so that the circular glass bulb lights; wherein said lamp power has a high frequency which is not less than 10 kHz and said lamp power is set within a range of 20 to 40 W or thereabout.

In preferred embodiments of this aspect, the range of 20 to 40 W or thereabout of the light power includes a rated lamp power and a high-output characteristic lamp power, said rated lamp power is approximately 23 W and said high-output characteristics lamp power is approximately 38 W.

This aspect of the present invention has an arrangement that the range of 20 to 40 W or thereabout of the light power includes a rated lamp power and a high-output characteristic lamp power, said rated lamp power is approximately 27 W and said high-output characteristics lamp power approximately 38 W.

With a view to achieving the such objects, according to another aspect of the present invention, there is provided a circular fluorescent lamp unit comprising a circular glass bulb having a circular outer diameter set within a range of 365 to 390 mm or thereabout, a tube outer diameter set within a range of 15 to 18 mm or thereabout, and an inner surface onto which a fluorescent substance is applied; a discharge medium including a rare gas and a mercury sealed up in the circular glass bulb; and a pair of electrode means fitted in both end portions of the circular glass bulb so as to be sealed therein whereby discharge occurs in the circular glass bulb by providing the pair of electrode means with a lamp power so that the circular glass bulb lights; wherein said lamp power has a high frequency which is not less than 10 kHz and said lamp power is set within a range of 28 to 50 W or thereabout.

In preferred embodiments of this another aspect, the range of 28 to 50 W or thereabout of the light power includes a rated lamp power and a high-output characteristic lamp power, said rated lamp power is approximately 30 W and said high-output characteristics lamp tower is approximately 48 W.

This another aspect of the present invention has an arrangement that the range of 28 to 50 W or thereabout of the light power includes a rated lamp power and a high-output characteristic lamp power, said rated lamp power is approximately 34 W and said high-output characteristics lamp power approximately 48 W.

For achieving the such objects, according to another aspect of the present invention, there is provided a circular fluorescent lamp unit comprising a circular glass bulb having a circular outer diameter set within a range of 210 to 235 mm or thereabout, a tube outer diameter set within a range of 15 to 18 mm or thereabout, and an inner surface onto which a fluorescent substance is applied; a discharge medium including a rare gas and a mercury sealed up in the circular glass bulb; and a pair of electrode means fitted in both end portions of the circular glass bulb so as to be sealed therein whereby discharge occurs in the circular glass bulb by providing the pair of electrode means with a lamp power so that the circular glass bulb lights; wherein said lamp power has a high frequency which is not less than 10 kHz and said lamp power is set within a range of 17 to 30 W or thereabout.

In preferred embodiments of this another aspect, the range of 17 to 30 W or thereabout of the light power includes a rated lamp power and a high-output characteristic lamp power, said rated lamp power is approximately 17 W and said high-output characteristics lamp power is approximately 28 W.

This another aspect of the present invention has an arrangement that the range of 17 to 30 W or thereabout of the light power includes a rated lamp power and a high-output characteristic lamp power, said rated lamp power is approximately 20 W and said high-output characteristics lamp power approximately 28 W.

To achieve the such objects, according to another aspect of the present invention, there is provided a lighting apparatus comprising a lighting body and at least one circular fluorescent lamp unit disposed in the lighting body, wherein said at least one circular fluorescent lamp unit comprises a circular glass bulb disposed in the lighting body having a circular outer diameter set within substantially one of ranges of 285 to 310 mm, 365 to 390 mm and 210 to 235 mm, a tube outer diameter of 15 to 18 mm or thereabout and an inner surface onto which a fluorescent substance is applied, a discharge medium including a rare gas and a mercury sealed up in the circular glass bulb, and a pair of electrode means fitted in both end portions of the circular glass bulb so as to be sealed therein and a lighting circuit for supplying the circular glass bulb of the at least one circular fluorescent lamp unit through the pair of electrode means thereof with a lamp power having a high frequency which is not less than 10 kHz, said lamp power being set within a range of 17 to 50 W or thereabout thereby occurring discharge in the circular glass bulb so that the circular glass bulb lights.

For achieving such objects, according to another aspect of the present invention, there is provided a lighting apparatus comprising a lighting body; at least one circular fluorescent lamp unit according to these aspects disposed in the lighting body, wherein said range of 20 to 40 W or thereabout of the light power includes a rated lamp power and a high-output characteristic lamp power; and a lighting circuit for supplying the circular glass bulb of the at least one circular fluorescent lamp unit through the pair of electrode means thereof with a lamp power having a high frequency which is not less than 10 kHz, and for controlling the supplying lamp power to the circular glass bulb of the at least one circular fluorescent lamp unit in that the supplying lamp power is switchable between the rated lamp power and the high-output characteristics lamp power.

A circular fluorescent lamp unit according to these aspects of the present invention substantially has the same dimension as those of the 30 W, 32 W and 40 W types of circular fluorescent lamp units hitherto widely used for the home-use lighting apparatus, nevertheless realizing the thickness reduction of the fluorescent lamp unit.

The circular outer diameter of the glass bulb is within the range of 15 to 18 mm. Although it is considered that there is a possibility that the circular outer diameter slightly decreases to be out of the aforesaid range when bending and processing the glass bulb, in the case of this invention, there is no problem as long as the major portions of the glass bulb are still within the above-mentioned range.

It has been known that in a fluorescent lamp unit the lamp efficiency more improves as its tube diameter decreases. For the lamp efficiency of the prior circular fluorescent lamp unit to reach the improvement of not less than 10%, it was found from experiments that the tube outer diameter is required to decrease to below 65%. That is, in the case of a glass bulb with a wall thickness of approximately 1 mm, the tube outer diameter can be set to be below 18 mm. In addition, it was found that this dimension can sufficiently achieve the thickness of the circular fluorescent lamp unit.

If the tube outer diameter is set to below 15 mm, the lamp efficiency can reach numeric satisfaction but the light output equivalent to that of the prior circular fluorescent lamp unit is unobtainable, so that it can not be put to practical use and further the bending processing of the glass bulb into a circular configuration becomes extremely difficult.

It is preferable that the circular diameter of the glass bulb is within a range of 5% of the prior circular outer diameter. For the glass bulb corresponding to 30 W, its circular outer diameter is 210 to 235 mm, while in the case of 32 W the circular outer diameter is 285 to 310 mm, and even the circular outer diameter is 365 to 390 mm for 40 W.

The reason why this ranges are preferable is that the tube outer diameter is reduced as approximated to the prior circular outer diameter so that the thickness reduction of the lamp unit is realizable while keeping the image of the prior circular fluorescent lamp unit in dimension and a large discharge path length is possible irrespective of a small tube outer diameter if approximated to the prior circular outer diameter.

Incidentally, when the circular outer diameter exceeds 390 mm, the discharge path length becomes excessively long to require an extremely higher starting voltage as compared with that of the prior art, which can create problems, such as raising the prices of the circuit parts, with the result that it is not highly realizable as a circular fluorescent lamp unit for general lighting apparatus.

When the circular fluorescent lamp unit which comprises a circular glass bulb having a circular outer diameter set within a range of 285 to 310 mm or thereabout and a tube outer diameter set within a range of 15 to 18 mm or thereabout defined those aspect of the present invention is lighted with the input of approximately 23 W, the lamp efficiency improves by approximately 10% as compared with the prior 32 W type circular fluorescent lamp unit, and in addition the lighting arises so as to output the total luminous flux with the substantially same level, and if the lighting is made with the input of approximately 38 W, the total luminous flux sharply more improves than that of the prior 32 W type circular fluorescent lamp unit and the lighting occurs with an efficiency of the substantially same level. If lighting at the input of 27 W, it is possible to output the total luminous flux similar to that of the prior art and further to develop the lamp efficiency.

However, the lighting do not always require the lamp power within the range of 20 to 40 W, but it is also possible that the lighting is made under the condition that a desired lamp power within this range is determined as a rated power.

When the circular fluorescent lamp unit which comprises a circular glass bulb having a circular outer diameter set within a range of 365 to 390 mm or thereabout and a tube outer diameter set within a range of 15 to 18 mm or thereabout of those aspects of the present invention is lighted with the input of approximately 30 W, the lamp efficiency increases by approximately 10% with respect to that of the prior 40 W circular fluorescent lamp unit, and the lighting occurs to output the total luminous flux with the substantially same level. Further, when being lighted with the input of approximately 48 W, not only the total luminous flux sharply increases than the prior 40 W circular fluorescent lamp unit but also the lighting occurs with the efficiency of the substantially same level. Still further, when being lighted with the input of approximately 34 W, it is possible to output the total luminous flux equal to that of the prior art and further to develop the lamp efficiency.

When the circular fluorescent lamp unit which comprises a circular glass bulb having a circular outer diameter set within a range of 210 to 235 mm or thereabout and a tube outer diameter set within a range of 15 to 18 mm or thereabout of those aspects of the present invention is lighted with the input of approximately 17 W, the lamp efficiency sharply increases as compared with the prior 30 W type circular fluorescent lamp unit, while the input of 28 W allows outputting a total luminous flux above that of the prior art and offering a lamp efficiency more than that of the prior art. Moreover, the input of approximately 20 W provides a middle total luminous flux a middle lamp efficiency between the case of 17 W and the case of 28 W, and permits a sharp improvement of the lamp efficiency with respect to the prior 30 W type and provides the total luminous flux with the same level.

However, the lighting do not always require the lamp power within the range of 28 to 50 W, but it is also possible that the lighting is made under the condition that a desired lamp power within this range causes the lighting.

In the above description, the rated lamp power signifies a lamp power indicated on the lamp unit as defined in JIS C 7601. This substantially equals the power outputted from a lighting circuit within an apparatus body when the lamp unit is mounted in a lighting apparatus.

According to the circular fluorescent lamp unit of these aspects of the present invention, having as it do a dimension substantially equal to that of a common lighting apparatus, it is possible to arrange a lighting apparatus which improves the sense of thickness reduction, and further to provide a lamp characteristic such as the total luminous flux and the efficiency which are equal or more than that of the prior circular fluorescent lamp unit.

In addition to the effects of the circular fluorescent lamp unit of these aspects of the present invention, the circular fluorescent lamp unit can further develop the lamp efficiency through the use of the fluorescent substances for the three wavelengths.

According to the circular fluorescent lamp unit of these aspects of the present invention which has the lighting circuit including the switching function, the lighting of the circular fluorescent lamp units is adjustable since the lighting circuit is operated in that the lighting power is switchable between the rated lamp power and the high-output characteristics lamp power. Therefore, when the lighting circuit is controlled in that the lighting power to is switchable between the rated lamp power and the high-output characteristics lamp power, the at least one circular fluorescent lamp unit is usable by appropriate selection in such a manner that these lamp powers are set to fit into e using conditions.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

Figure 1:
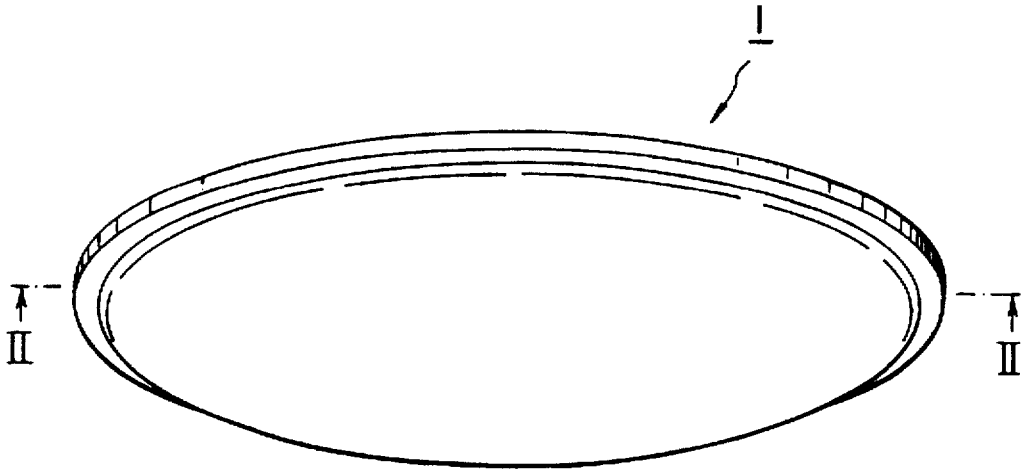
FIG. 1 is a perspective view showing a lighting apparatus in accordance with a first embodiment of the present invention.

Referring to the drawings, a description will be made hereinbelow of constructions of a circular fluorescent lamp unit and a lighting apparatus according to embodiments of the present invention.

FIGS. 1 to 4 show a first embodiment of the present invention.

In FIGS. 1–4, t he lighting apparatus 1 is set, for example, on a ceiling in a dwelling. The lighting apparatus 1 has, for example, two circular fluorescent lamp units 2*a*, 2*b* each of which is concentrically arranged in a different plane in the lighting apparatus 1. The circular fluorescent lamp units 2*a*, 2*b* each has a ring-like (circular) glass bulb 3 which hermetically accommodates a discharge medium comprising a rare gas and a mercury. The glass bulb 3 is made of, for example, a soft glass such as a soda-lime glass and a lead glass, while it can also be made of a hard glass such as a borosilicate glass and a quartz glass. The wall thickness of the bulb 3 is preferable to be approximately 0.8 to 1.2 mm, but not limited to these values. Moreover, the rare gas to be sealed up in the bulb 3 includes argon, neon, krypton, and others.

On an inner wall surface of the glass bulb 3, there are formed a protective layer made of an metal oxide fine particulates, such as an alumina ($Al^2 O^3$), silica ($SiO^2$) or other similar fine particulates which are well known, and a fluorescent substance layer made of fluorescent substances for emission of light with three wavelengths. Both the end portions of the glass bulb 3, there are placed filament electrodes serving as a pair of electrode means by a stem portion including a lead wire for supporting the electrode.

To the pair of electrode means, a hot cathode type electrode is applicable, where an emitter substance is applied to the filament, while different electrode means are also practicable. Incidentally, in the case of the high-output lighting of the circular fluorescent lamp unit being necessary, it is desirable to use a triple coil for the hot cathode type electrode.

In addition, the fluorescent substance may be of a type of emitting light with three wavelengths which are substantially 450 nm, substantially 540 nm and substantially 610 nm in peak wavelength. For the substances for emitting the three wavelengths, for example $BaMg^2 Al^{16} O^{27}$ :$Eu^{2+}$is applicable as a blue fluorescent substance having an emission peak wavelength in the vicinity of 450 nm, (La, Ce, Tb) $PO^4$ is applicable as a green fluorescent substance having an emission peak wavelength in the vicinity of 540 nm, and $Y^2 O^3$: $Eu^{3+}$ is applicable as a red fluorescent substance having an emission peak wavelength in the vicinity of 610 nm. However, this embodiment of the invention is not limited to these substances.

A base 4 is arranged between both the end portions thereof. In the base 4, four base pins 5 electrically connected to the electrodes are provided so as to be inclined toward the lamp center side and to project toward the lamp center side. The four base pins 5 are disposed in the base 4 to make a rectangular configuration, and pairs of pins are located between the filaments to define a large separation therebetween.

In the case that the separation between the pair of pins fitted between the filaments is set to approximately 6 mm while the separation between the pairs of pins is set to approximately 10 mm, the base pin separation dimensions can be different from those previously standardized in order to inhibit the connection of the prior socket to this base 4, thereby preventing the mistaken insertion. In this case, it can also be expected to improve the withstand voltage between the electrodes.

Figure 2:
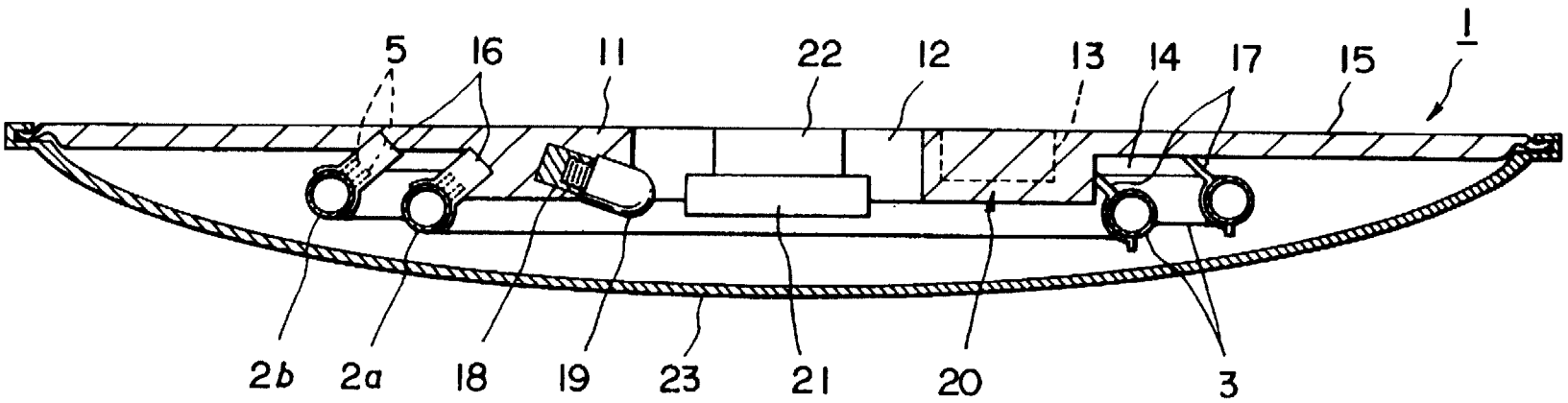
FIG. 2 is a vertically cross sectional view taken on line II—II of FIG. 1.
Figure 3:
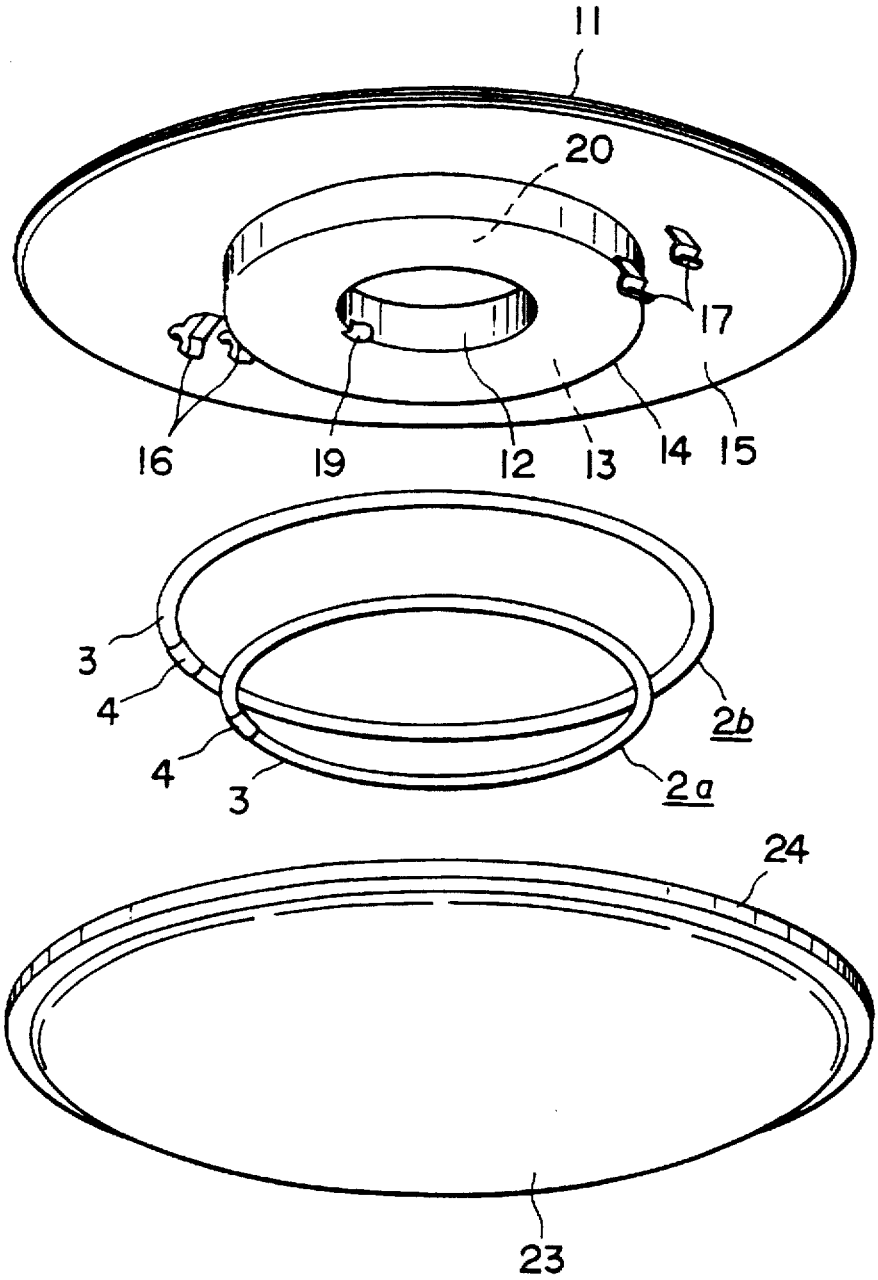
FIG. 3 is a perspective view showing the an exploded state of the lighting apparatus in FIG. 1.

As shown in FIGS. 2 and 3, two lamp units, the circular fluorescent lamp unit 2*a* corresponding to a 32 W type and the circular fluorescent lamp unit 2*b* corresponding to a 40 W type, are used for the lighting apparatus 1.

The circular fluorescent lamp unit 2*a* corresponding to the 32 W type is made so that the ring (circular) outer diameter D1 of the glass bulb 3 is 299 mm, the circular inner diameter D2 is 267 mm when the circular outer diameter D1 is 299 mm, the tube outer diameter d is 16.5 mm and the wall thickness of the glass bulb 3 is 1.1 mm.

The circular fluorescent lamp unit 2*b* corresponding to the 40 W type is made so that the circular outer diameter D1 of the glass bulb 3 is 373 mm, the circular inner diameter D2 is 341 mm when the circular outer diameter D1 is 373 mm, the tube outer diameter d is 16.5 mm and the wall thickness of the glass bulb 3 is 1.1 mm.

Still further, this is valid for a circular fluorescent lamp unit 2*c* corresponding to the 30 W type, and the circular fluorescent lamp unit 2*c* is made so that the circular outer diameter D1 of the glass bulb 3 is 225 mm, the circular inner diameter D2 is 192 mm when the circular outer diameter D1 is substantially 225 mm, the tube outer diameter d is 16.5 mm and the wall thickness of the glass bulb 2 is 1.1 mm.

Figure 4:
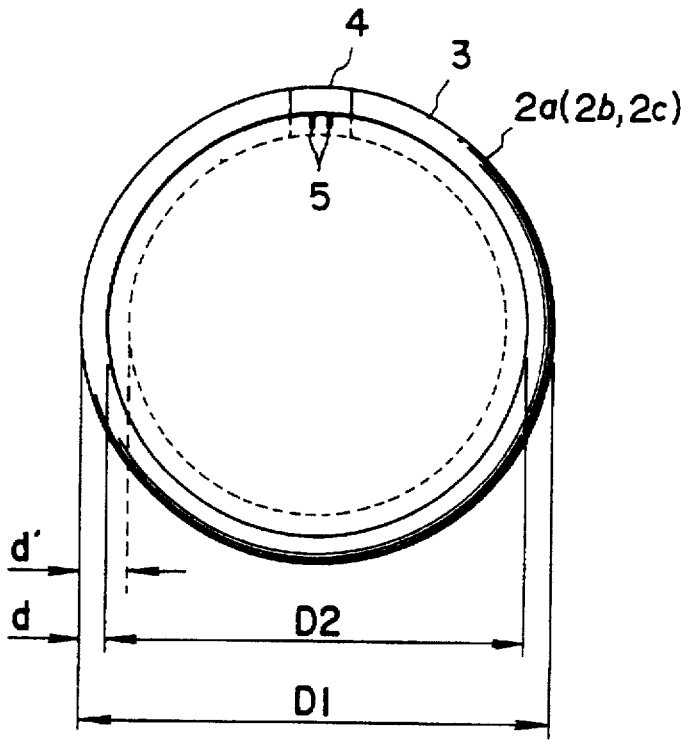
FIG. 4 is a plan view showing a circular fluorescent lamp unit provided in the lighting apparatus according to the first embodiment.

In FIG. 4, a unit indicated by a dotted line inside the circular fluorescent lamp unit 2 represents the circular inner peripheral surface of a prior circular fluorescent lamp unit, where the tube outer diameter of the prior circular fluorescent lamp unit is 29 mm. That is, the circular fluorescent lamp unit 2 (2*a*, 2*b*, 2*c*) has the circular outer diameter D1 corresponding to that of the prior circular diameter of the prior circular fluorescent lamp unit but the tube outer diameter d of the circular fluorescent lamp unit 2 (2*a*, 2*b*, 2*c*) is smaller than the tube outer diameter d of the prior circular fluorescent lamp unit.

A fluorescent substance providing three wavelengths and a correlated color temperature of 5000k is applied onto an inner wall surface of the glass bulb 3 of each of the circular fluorescent lamp units 2*a*, 2*b* (and 2*c*), and then burned to form a fluorescent substance layer.

Numeral 11 depicts an apparatus body which is made so that its outside appearance has a circular and thin configuration. A circular opening portion 12 is vertically made in its central portion, and around this opening portion 12 there is formed a containing portion 13 having a containing space and further around this containing portion 13 there is made a step portion 14 for locating the circular fluorescent lamp units 2*a*, 2*b*. A circular-like plate portion 15 above this step portion 14 is constructed to have a flat plate configuration thinner than the vertical thickness of the housing portion 13.

In the step portion 14 of the apparatus body 11, a pair of sockets 16 for the connections with the bases 4 of the two circular fluorescent lamp units 2*a*, 2*b* are disposed outwardly and obliquely, and further at a position symmetrical with the position of the socket 16, a pair of lamp holders 17 made of a metal or resin are placed in order to be fitted over the outer circumference of the glass bulb 3 so as to hold it.

In the containing portion 13 of the apparatus body 11, a socket 18 is installed to face the opening portion 12, while a baby bulb 19 is screwed into and connected to this socket 18.

The two circular fluorescent lamp units 2*a*, 2*b* having the different circular ring diameters each other described above are respectively fitted in the circular step portion 14 of the apparatus body 11, whereby the base pins 5 projecting from the base 4 of the fluorescent lamp units 2*a*, 2*b* are inserted into and connected to the socket 16. The glass bulb 3 positioned in the opposite side to the base 4 is held by the lamp holder 17. Further, the socket 18 is connected to the baby bulb 19.

The space of the containing portion 13 of the apparatus body 11 accommodates a high-frequency lighting circuit 20 comprising an inverter lighting circuit. An adaptor 21 is electrically coupled through an electric line (not shown) or the other similar electrically connecting device to the power input side of this high-frequency lighting circuit 20, whereas the respective sockets 16 are electrically connected through electric wires or the like to the output side thereof. As a result of that, the fluorescent lamp units 2*a*, 2*b* are electrically connected to the high-frequency lighting circuit 20 through the bases 4 (base pins 5) and the sockets 16, respectively.

The high-frequency lighting circuit 20 lights the 32 W type circular fluorescent lamp unit 2*a* on the conditions meeting a high frequency of 45 kHz and a lighting power of 38 W for high-output characteristic, for example, on the conditions of the supply of the lamp current of substantially 430 mA and the lamp voltage of substantially 88 V.

Incidentally, the high frequency of the present invention represents a frequency of which is not less than 10 kHz. Moreover, the same high-frequency lighting circuit 20 lights the 40 W type circular fluorescent lamp unit 2*b* on the conditions of a high frequency of 45 kHz and a lamp power of 48 W for high-output characteristic, for example, on the conditions of the supply of the lamp current of substantially 430 mA and the lamp voltage of approximately 111V. Further, in the case of the 30 W type circular fluorescent lamp unit 2c, the condition is that the high frequency is 45 kHz and the lamp power is 28 W for high-output characteristic, for example, the supply of the lamp current of substantially 430 mA and the lamp voltage of substantially 65 V.

The adaptor 21 is designed to have a disc-like configuration low in height and is integrally fixed through a connecting portion, not shown, to the apparatus body 11 at a lower side within the opening portion 12 of the apparatus body 11. The adaptor 21 is also coupled to the power input side of the discharge lamp lighting unit 20 through an electric wire or other similar electrically connecting devices laid along the connecting portion.

Further, the adaptor 21 is electrically coupled to a rectangular hooking ceiling 22 directly attached to, for example, the surface of the ceiling of the dwelling and further mechanically supported thereby. In addition, the lighting apparatus 1 having the adaptor 21 may be suspended from the ceiling, or attached on a surface of a wall in the dwelling.

To the apparatus body 11, there is attached a shade 23 which covers the lower portion and side portions of the apparatus body 11. This shade 23 is made of an opalescent and translucent and formed to have a thin configuration so as to shape a large circular arc surface gently projecting downwardly. A fitting portion 24 is formed at its circular edge portion so as to be attached to the apparatus body 11. Moreover, the apparatus body 11 may be attached a globe which covers the lower portion and side portions thereof and a reflector shade and other similar attachments. It is also appropriate that the apparatus body 11 is of the type that the circular fluorescent lamp unit is in an exposed state or of the type of being provided with a light guiding plate.

Next, a description will be taken of an operation of the first embodiment.

As illustrated in FIG. 2, the apparatus body 11 is fixedly supported to the ceiling surface through the adaptor 21, connected to the hooking ceiling 22 attached thereon. The apparatus body 11 side is electrically coupled to the hooking ceiling 22 side.

At the time of lighting the circular fluorescent lamp units 2a, 2b (or 2c) and at the time of lighting the baby bulb 19, the light emitted from the circular fluorescent lamp units 2a, 2b and the baby bulb 19 pass through the shade 23 to accomplish the illumination.

Furthermore, the 32 W type circular fluorescent lamp unit 2a and the 40 W type fluorescent lamp unit 2b light in response to the supply of the lamp powers of 38 W and 48 W having a high frequency of 45 kHz from the high-frequency lighting circuit 20, respectively. In the case that the 30 W type circular fluorescent lamp unit 2c is mounted, the high-frequency lighting circuit 20 supplies a lamp power of 28 W at a high frequency of 45 kHz, so that the 30 W type circular fluorescent lamp unit 2c lights.

Since each of the circular fluorescent lamp units 2a, 2b (and 2c) substantially has the same circular outer diameter D1 as those of the prior 32 W type, 40 W type (and 30 W type) but has the smaller tube outer diameter de as those of the prior 32 W type, 40 W type (and 30 W type), it is possible to allow the thickness reduction of the apparatus body 11 and whole of the lighting apparatus 1 in a state with maintaining the image of the conventional type of apparatus body and lighting apparatus in dimension. Further, it is possible to provide the light output substantially equal to those of the prior 32 W, 40 W and 30 W type circular fluorescent lamp units.

Figure 5:
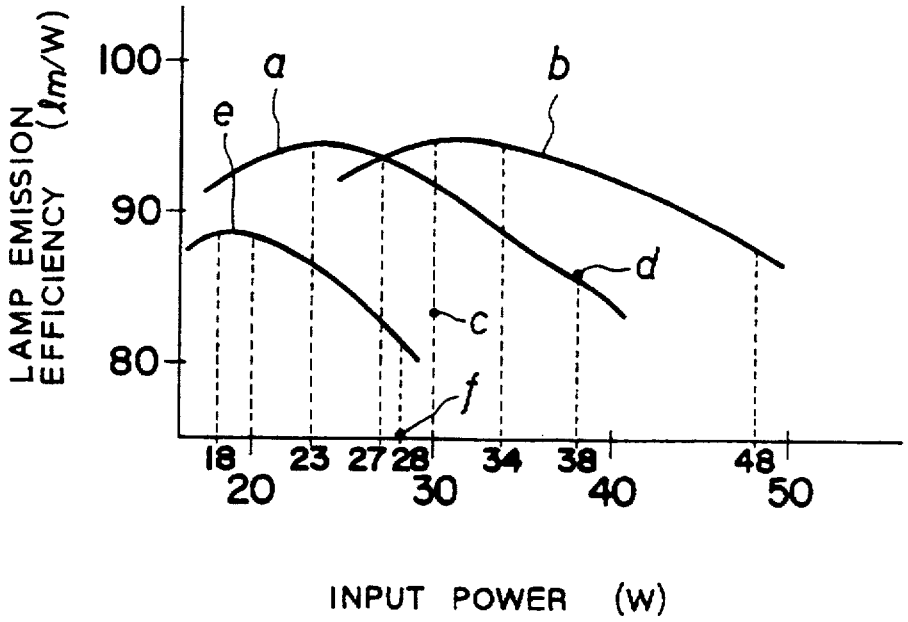
FIG. 5 is a comparison graph showing the relationship between the input powders (W) and the lamp emission efficiency (lm/W) of the circular fluorescent lamp unit of the first embodiment and a prior circular fluorescent lamp unit;.
Figure 6:
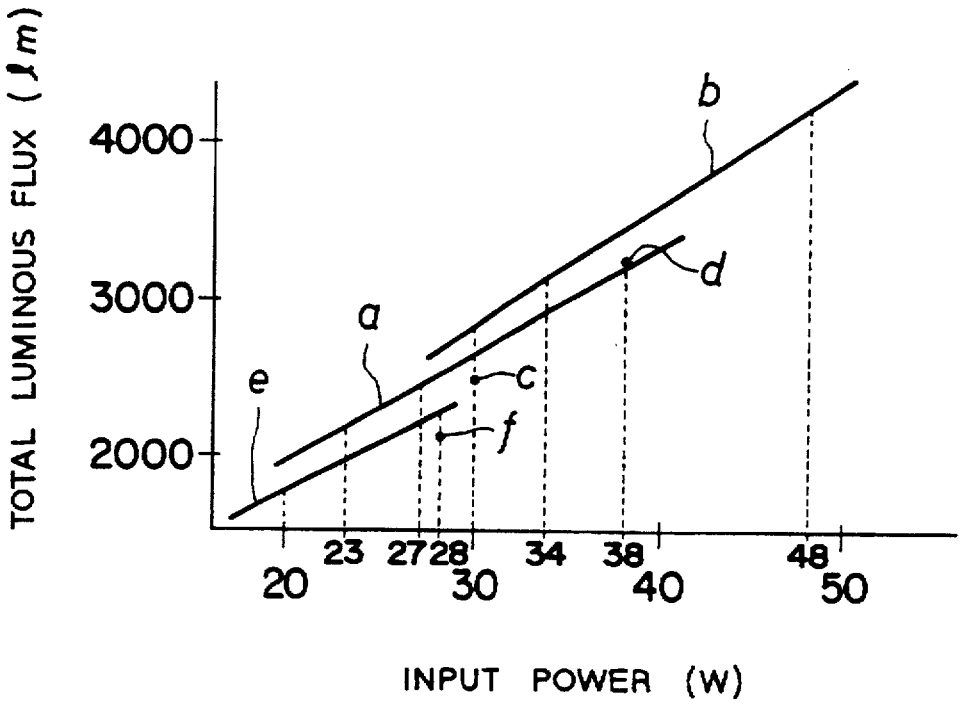
FIG. 6 is a comparison graph showing the relationship between the input powers (W) and the total luminous fluxes of the first embodiment and a prior circular fluorescent lamp unit.

FIGS. 5 and 6 are graphic illustrations indicating experimental results on the comparison in lamp characteristic between the circular fluorescent lamp units 2a, 2b and 2c according to the first embodiment and the prior circular fluorescent lamp units. FIG. 5 is a graph representating the relationship between the input powers (W) and the lamp emission efficiencies (lm/W) and FIG. 6 is a graph indicating the relationship between the input powers (W) and the total luminous flux (lm).

In FIGS. 5 and 6, "a" represents the efficient value or the luminous flux value of the 32 W type circular fluorescent lamp unit 2a, "b" designates the efficient value or the luminous flux value of the 40 W type circular fluorescent lamp unit 2b, and "c", "d" denote the efficient values or the luminous flux values of the prior 32 W and 40 W type circular lamp units, respectively. Further, "e" depicts the efficient value or the luminous flux value of the 30 W type circular fluorescent lamp unit 2c and "f" signifies the efficient value or the luminous flux value of the prior 30 W type circular fluorescent lamp unit.

A table 1 shows the various characteristics of the circular fluorescent lamp units 2a, 2b and 2c used in this experiment and the prior fluorescent lamp units (FCL32EX-N/30 of the 32 W type, FCL40EX-N/38 of the 40 W type, FCL30EX-N/28 of the 30 W type, manufactured by TOSHIBA LIGHTING TECHNOLOGY CORPORATION). All the lighting frequencies of the circular fluorescent lamp units 2a, 2b and 2c are 45 kHz. The total luminous flux is the initial value taken when 100 hours pass after the start of lighting.

TABLE 1

| Kind of Lamp Unit | Dimensions (mm) Tube Outer Diameter | Circular Diameter Outer Diameter | Circular Diameter Inner Diameter | Lamp Power (W) | Lamp Characteristics Lamp Current (A) | Total Luminous Flux (lm) | Efficiency (lm/W) | Rated Life (h) |
|---|---|---|---|---|---|---|---|---|
| 32 W Type Lamp Unit 2a | 16.5 | 299 | 267 | 23 | 0.165 | 2180 | 94.8 | 9000 |
| | | | | 2.7 | 0.230 | 2510 | 93.0 | 9000 |
| | | | | 38 | 0.430 | 3250 | 85.5 | 9000 |
| 40 W Type Lamp Unit 2b | 16.5 | 373 | 341 | 30 | 0.165 | 2860 | 95.3 | 9000 |
| | | | | 34 | 0.230 | 3270 | 96.2 | 9000 |
| | | | | 48 | 0.430 | 4250 | 88.5 | 9000 |
| 30 W Type Lamp Unit 2c | 16.5 | 225 | 192 | 17 | 0.165 | 1560 | 91.8 | 9000 |
| | | | | 20 | 0.230 | 1800 | 90.0 | 9000 |
| | | | | 28 | 0.430 | 2300 | 82.0 | 9000 |
| FCL32EX-N/30 (Prior Art) | 29 | 299 | 241 | 30 | 0.425 | 2510 | 83.7 | 6000 |

TABLE 1-continued

| Kind of Lamp Unit | Dimensions (mm) Tube Outer Diameter | Circular Diameter Outer Diameter | Circular Diameter Inner Diameter | Lamp Power (W) | Lamp Characteristics Lamp Current (A) | Total Luminous Flux (lm) | Efficiency (lm/W) | Rated Life (h) |
|---|---|---|---|---|---|---|---|---|
| FCL40EX-N/38 (Prior Art) | 29 | 373 | 315 | 38 | 0.425 | 3270 | 86.1 | 6000 |
| FCL30EX-N/28 (Prior Art) | 29 | 225 | 167 | 28 | 0.600 | 2100 | 75.0 | 6000 |

In FIG. 5, as obvious from the curves "a", "b" and "e", the 32 W type circular fluorescent lamp unit 2a produces the peak lamp efficiency at substantially 23 W, the 40 W type circular fluorescent lamp unit 2b produces the peak lamp efficiency at substantially 30 W, and the 30 W type circular fluorescent lamp unit 2c develops the peak lamp efficiency at substantially 18 W, with these peak lamp efficiency exceeding the lamp efficiencies "c", "d" and "f" of the prior 32 W, 40 W and 30 W type circular fluorescent lamp units.

Therefore, referring FIG. 5, when the 32 W type circular fluorescent lamp unit 2a performs the rated lighting within the range of 20 to 40(W) or thereabout, the lamp efficiency of the 32 W type circular fluorescent lamp unit 2a is higher than that of the prior circular fluorescent lamp unit. Similarly, referring FIG. 5, the 40 W type circular fluorescent lamp unit 2b performs the rated lighting within the range of 28 to 50(W) or thereabout and the 30 W type circular fluorescent lamp unit 2c performs the rated lighting within the range of 17 to 30(W) or thereabout.

In FIG. 6, as obvious from the lines "a", "b" and "e", the total luminous fluxes go above those "c", "d" and "f" of the prior 32 W, 40 W and 30 W circular fluorescent lamp units, and as the input power to the lamp unit increases, the total luminous flux increases.

However, taking into consideration the lamp efficiency, when the 32 W type circular fluorescent lamp unit 2a performs the rated lighting at substantially 38 W, the value of which represents the high-output characteristics lamp power of 32 W type, the 40 W type circular fluorescent lamp unit 2b develops the rated lighting at substantially 48 W, the value of which represents the high-output characteristics lamp power of 40 W type, and the 30 W type circular fluorescent lamp unit 2c accomplishes the rated lighting at substantially 28 W, the value of which represents the high-output characteristics lamp power of 30 W type, it is obvious that the high-output lighting is possible while satisfying the actual using conditions.

Referring to the tablel, if the lamp power of the circular fluorescent lamp unit 2a is set to 23 W of which is the rated lamp power, the efficiency comes to 94.8 lm/W which is by far higher than 83.7 lm/W of the prior 32 W type circular fluorescent lamp unit, thus accomplishing the power-saving, and further it is possible to obtain the initial luminous flux with a light output level of 2180 lm which is not greatly different from 2510 lm of the prior art.

Furthermore, when the lamp power of the circular fluorescent lamp unit 2a is set to substantially 38 W of which is the high-output characteristic lamp power, the initial luminous flux becomes 3250 lm which is by far greater than 2510 lm of the prior 32 W type circular fluorescent lamp unit, thus obtaining a high output, and further it is possible to attain the efficiency with a level substantially equal to 85.5 lm/W as compared with 83.7 lm/W of the prior art.

Still further, when the lamp power of the circular fluorescent lamp unit 2a is set to substantially 27 W of the rated lamp power, the initial luminous flux becomes 2510 lm which is equivalent to that of the prior 32 W type circular fluorescent lamp unit, while the efficiency can greatly improve to 93.0lm/W as compared with 83.7 lm/W of the prior art.

In addition, as comparison between the lamp powers of 23 w, 27 W and 38 W, when the lamp power of the circular fluorescent lamp unit 2a is set to 23 W or 27 W of the rated lamp power, the light efficiency is greater than that of the lamp power of the circular fluorescent lamp unit 2a which is set to 38 W of the high-output characteristics lamp power. On the other hand, when the lamp power of the circular fluorescent lamp unit 2a is set to 38 W of the high-output characteristic lamp power, the initial luminous flux (lighting output) is greater than that of the lamp power of the circular fluorescent lamp unit 2a which is set to 23 w or 27 W of the rated lamp power. That is, the lamp power 23 W or 27 W is the lamp power for gaining the high-light efficiency of the circular fluorescent lamp unit 2a and the lamp power 38 W is the lamp power for gaining the high-lighting output of the circular fluorescent lamp unit 2a.

Similarly, as reference to the table 1, when the lamp power of the circular fluorescent lamp unit 2b is set to 30 W of which is the rated lamp power, the efficiency comes to 95.3 lm/W which is by far superior to 86.1 lm/W of the prior 40 W circular fluorescent lamp unit to allow the power-saving, and the initial luminous flux is 2860 lm which is not largely different in light output level from 3270 lm of the prior art.

Furthermore, when the lamp power of the circular fluorescent lamp unit 2b is set to 48 W of which is the high-output characteristics lamp power, the initial luminous flux 4250 lm which extremely exceeds 3270 lm of the prior 40 W circular fluorescent lamp unit to attain a high output, besides the efficiency is 88.5 lm/W which is substantially equal in level top 86.1 lm/W of the prior art.

Still further, when the lamp power of the circular fluorescent lamp unit 2b is set to 34 W of which is the rated lamp power, the initial luminous flux becomes 3270 lm which is equivalent to that of the prior 40 W circular fluorescent lamp unit, besides the efficiency can greatly improve 96.2 lm/W as compared with 86.1 lm/W of the prior art.

As comparison between the lamp powers of 30 w, 34 W and 48 W, when the lamp power of the circular fluorescent lamp unit 2b is set to 30 W or 34 W of the rated lamp power, the light efficiency is greater than that of the lamp power of the circular fluorescent lamp unit 2b which is set to 48 W of the high-output characteristics power, whereas, when the lamp power of the circular fluorescent lamp unit 2a is set to 38 W, the initial luminous flux (lighting output) is greater than that of the lamp power of the circular fluorescent lamp unit 2b which is set to 30 w or 34 W. That is, the lamp power 30 W or 34 W is the lamp power for gaining the high-light efficiency of the circular fluorescent lamp unit 2b and the lamp power 48 W is the lamp power for gaining the highlighting output of the circular fluorescent lamp unit 2b.

As the same, referring to the table 1, when the lamp power of the circular fluorescent lamp unit 2c is set to 17 W of which is the rated lamp power, the efficiency becomes 91.8 lm/W which is by far higher than 75.0 lm/W of the prior 30 W type circular fluorescent lamp unit, thus permitting the power-saving.

Furthermore, when the lamp power of the circular fluorescent lamp unit 2c is set to 28 W of which is the high-output characteristics lamp power, the initial luminous flux becomes 2300 lm which is by far higher than 2100 lm of the prior 30 W type circular fluorescent lamp unit designed as a unit of a relatively high output type, thus attaining a high output, and further the efficiency can greatly improve to 82.0 lm as compared with 75.0 lm of the prior art.

Still further, the lamp power of the circular fluorescent lamp unit 1c is set to 20 W of which is the rated lamp power, the initial luminous flux becomes 1800 lm which is made close to 21001 of the prior art designed as a unit of a relatively high output type, besides the efficiency can considerably improve to 90.0 lm/W as compared with 75.0 lm/W of the prior art.

As comparison between the lamp powers of 17 w, 20 W and 28 W, when the lamp power of the circular fluorescent lamp unit 2c is set to substantially 17 W or 20 W of the rated lamp power, the light efficiency is greater than that of the lamp power of the circular fluorescent lamp unit 2c which is set to 28 W, whereas, when the lamp power of the circular fluorescent lamp unit 2a is set to approximately 28 W, the initial luminous flux (lighting output) is greater than that of the lamp power of the circular fluorescent lamp unit 2c which is set to 17 w or 20 W. That is, the lamp power 17 W or 20 W is the lamp power for gaining the high-light efficiency of the circular fluorescent lamp unit 2c and the lamp power 28 W is the lamp power for gaining the high-lighting output of the circular fluorescent lamp unit 2c.

As described above, in this embodiment, since the circular fluorescent lamp units 2a, 2b (and 2c) have a smaller tube outer diameter than that of the prior circular fluorescent lamp unit, respectively, the whole of the lighting apparatus 1 in which the circular fluorescent lamp units 2a, 2b (and 2c) are accomodated can be made to have a thin configuration, whereby the appearance of the lighting apparatus 1 becomes fine and it is possible to soften the oppressive sensation in the dwelling. Further, the more power-saving and the higher output are possible as compared with the case of using the prior circular fluorescent lamp unit substantially equal in circular outer diameter.

Although in this embodiment the two-lamp apparatus using the two circular fluorescent lamp units 2a, 2b (or 2c) has been described, even if employing a one-lamp apparatus using any one of the respective circular fluorescent lamp units 2a, 2b and 2c or employing a multi-lamp apparatus using them, the similar operation and effects are obtainable.

In this embodiment, it is especially shown to light the circular fluorescent lamp unit 2a by the lamp powers set to 23 W, 38 W, and 27 W. However, the present invention is not limited to those values of the lamp power. That is, the circular fluorescent lamp unit 2a may light by the values of the lamp power within the range of 20 to 40 W but the lighting of the circular fluorescent lamp unit 2a do not always require the lamp power within the range of 20 to 40 W, but it is also possible that the lighting is made under the condition that a desired lamp power within this range is determined as a rated power.

Similarly, in this embodiment, it is especially shown to light the circular fluorescent lamp unit 2b by the lamp powers set to substantially 30 W, 34 W, and 48 W. However, the present invention is not limited to those values of the lamp power. That is, the circular fluorescent lamp unit 2b may light by the values of the lamp power within the range of 28 to 50 W but the lighting of the circular fluorescent lamp unit 2b do not always require the lamp power within the range of 28 to 50 W, but it is also possible that the lighting is made under the condition that a desired lamp power within this range is determined as a rated power.

As the same, in this embodiment, it is especially shown to light the circular fluorescent lamp unit 2c by the lamp powers set to substantially 17 W, 20 W, and 28 W. However, the present invention is not limited to those values of the lamp power. That is, the circular fluorescent lamp unit 2c may light by the values of the lamp power within the range of 17 to 30 W but the lighting of the circular fluorescent lamp unit 2c do not always require the lamp power within the range of 17 to 30 W, but it is also possible that the lighting is made under the condition that a desired lamp power within this range is determined as a rated power.

In addition to the effects of this embodiment, the circular fluorescent lamp units 2a–2c can further develop the lamp efficiency through the use of the fluorescent substances for the three wavelengths.

Moreover, in this embodiment, the tube outer diameter of the glass bulb 3 of the circular fluorescent lamp units 2a–2c is set to 16.5 mm. However, the present invention is not limited to the value of the tube outer diameter thereof. That is, the tube outer diameter of the glass bulb of the present invention is preferably set within the range of 15 to 18 mm or thereabout so that the lamp efficiency of the circular fluorescent lamp units 2a–2c is improved than that of the prior circular fluorescent lamp unit and that the light output of the circular fluorescent lamp units 2a–2c is not less than that of the prior circular fluorescent lamp unit. Moreover, it is easy to make the bending processing of the glass bulb 3 into the circular configuration of the circular fluorescent lamp units 2a–2c.

Furthermore, in this embodiment, the circular outer diameter of the circular fluorescent lamp unit 2a is set to 299 mm, the circular outer diameter of the circular fluorescent lamp unit 2b is set to 373 mm, and the circular outer diameter of the circular fluorescent lamp unit 2c is set to 225 mm but the present invention is not limited to the values of the circular outer diameters thereof. That is, it is preferable that the circular diameters of the circular fluorescent lamp unit 2a–2c are within a range of 5% of the prior circular outer diameter. For the glass bulb 3 corresponding to the circular fluorescent lamp unit 2a, its circular outer diameter is 285 to 310 mm or thereabout, while in the case of the glass bulb 3 corresponding to the circular fluorescent lamp unit 2b the circular outer diameter is 365 to 390 mm thereabout, and even the circular outer diameter is 210 to 235 mm or thereabout for the glass bulb 3 corresponding to the circular fluorescent lamp unit 2c.

The reasons why this ranges are preferable is that the circular outer diameters of the circular fluorescent lamp units 2a–2c are reduced as approximated to the prior circular outer diameter so that the thickness reduction of the lamp units 2a–2c are realizable while keeping the image of the prior circular fluorescent lamp unit in dimension, respectively, and that a large discharge path length of the lamp units 2a–2c is possible irrespective of a small circular outer diameter if approximated to the prior circular outer diameter.

Incidentally, when the circular outer diameters of the lamp units 2a–2c exceeds 390 mm, the discharge path length thereof becomes excessively long to require an extremely higher starting voltage as compared with that of the prior art so that the price of the lighting circuit parts is raised. Therefore, it is highly realizable as the circular fluorescent lamp units 2a–2c for general lighting apparatus that the circular outer diameters of the lamp units 2a–2c are not more than 390 mm.

By the way, in this embodiment, it is able to light the lamp units 2a–2c by supplying them with the lamp power in which the high-light efficiency is gained, for example in the lamp unit 2a, such as 23 w or 30 W and with the lamp power in which the high-lighting output is gained, for example in the lamp unit 2a, such as 38 W. In the present invention, it is also able to light the lamp units 2a–2c while switching to one of the supplied lamp power between the lamp power in which the high-light efficiency is gained and the lamp power in which the high-lighting output is gained. Moreover, the lamp power in which the high-light efficiency is gained is called "first mode lamp power" and the lamp power in which high-lighting output is gained is called "second mode lamp power".

Figure 7:
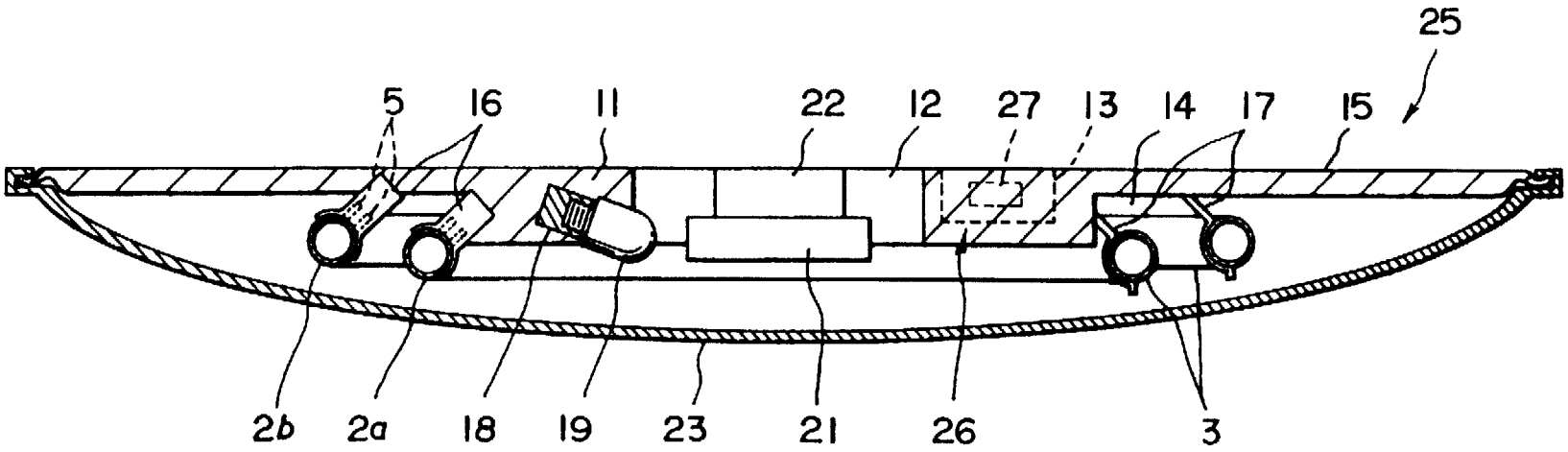
FIG. 7 is a vertically cross sectional view of a lighting apparatus having a circular lamp unit in accordance with a modification of the first embodiment of the present invention.

Here, FIG. 7 shows a perspective view related to a lighting apparatus 25 of the modification of this embodiment. In FIG. 7, the space of the containing portion 13 of the apparatus body 11 accommodates a high-frequency lighting circuit 26 includes a switching means 27 which supplies the circular fluorescent lamp units 2a–2c with a lighting power, said lighting power being switchable between the first mode lamp power and the second mode lamp power.

The switching means 27 may be switch the lighting power to be supplied between only the first mode lamp power and the second mode lamp power or may be continuously switch the lighting power to be supplied in that the lighting power thereto is continuously changed between the first mode lamp power and the second mode lamp power.

In this modification, the lighting of the circular fluorescent lamp units is adjustable since the switching means 27 of the high-frequency lighting circuit 26 is operated so as to switch the lighting power to be supplied between the first mode lamp power and the second mode lamp power. For instance, if the switching means 27 may be switch the lighting power to be supplied between only the first mode lamp power and the second mode lamp power, the circular fluorescent lamp units are usable by appropriate selection in such a manner that these modes of the lamp powers are set to fit into the using conditions.

Figure 8A:
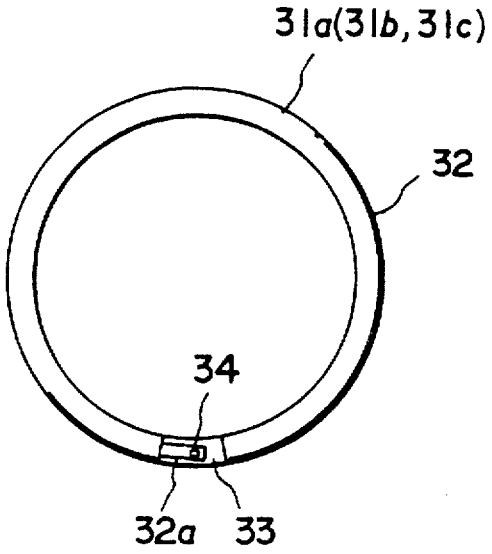
FIG. 8(A)–8(C) are a plan view showing a circular fluorescent lamp unit according to a second embodiment of the present invention.
Figure 8B:
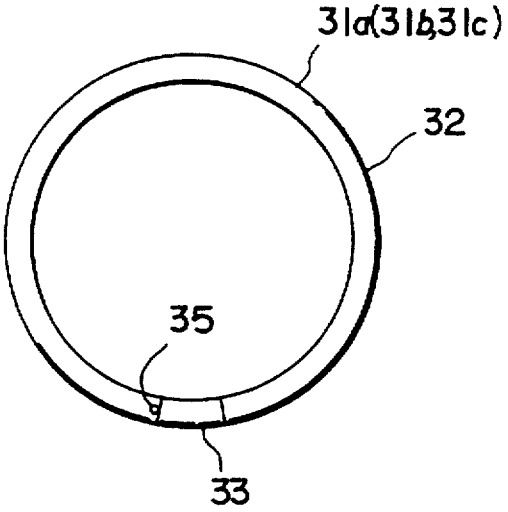
Figure 8C:
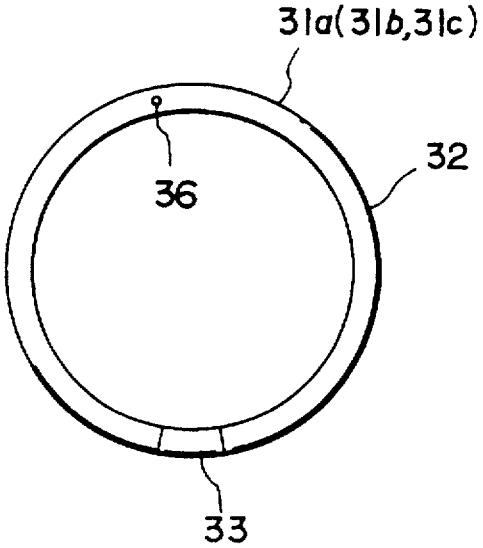
Figure 9:
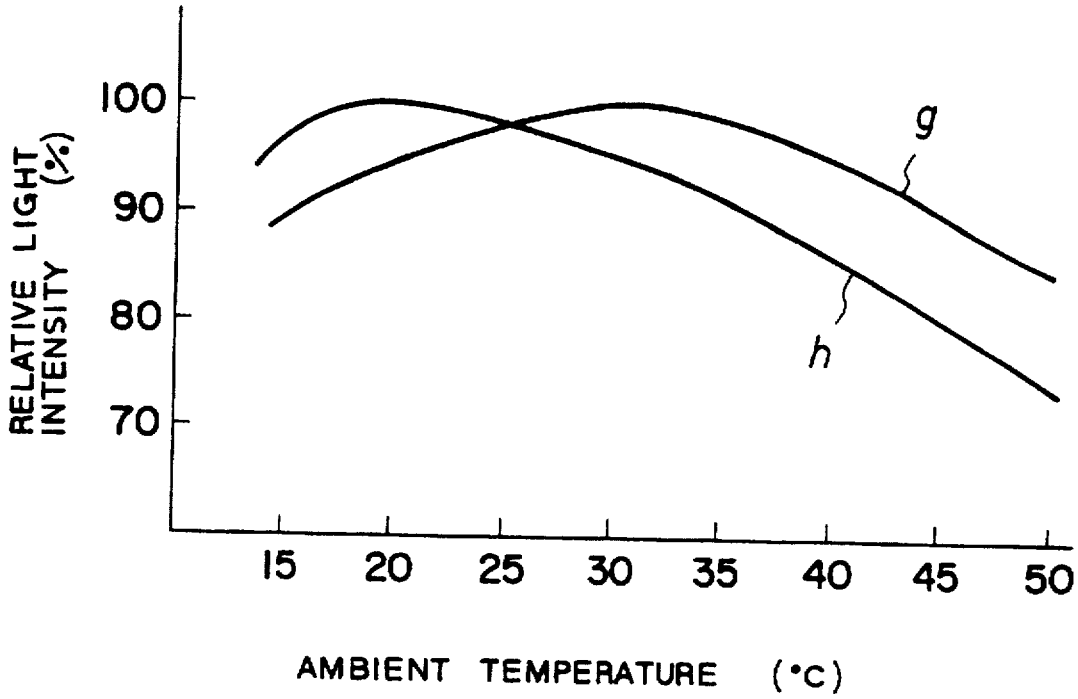
FIG. 9 is a characteristic view showing the relationship between the ambient temperature and relative light intensity in the second embodiment.

FIGS. 8(A)–8(C) and FIG. 9 illustrate a second embodiment of the present invention. That is, FIGS. 8(A), 8(B) and 8(C) are plan views showing a circular fluorescent lamp unit 31a, 31b or 31c according to the second embodiment and FIG. 9 is a characteristic diagram showing the relationship between the ambient temperature (°C.) and the relative light intensity (%) according thereto.

In the circular fluorescent lamp unit 31a, 31b or 31c of a lighting apparatus of the second embodiment shown in FIG. 8(A), an amalgam 34 is fixedly sealed up in an internal position of a discharge pipe 32a provided at an end portion of a glass bulb 32, i.e., in the vicinity of the electrode placed at the end portions thereof.

The vicinity of the electrode signifies the position of the lead wire for supporting the electrode, the stem for supporting this wire, the interior of a capillary, such as the discharge pipe 32a placed on this stem, or the like. The amalgam 34 is fixed to the vicinity portions to with respect to the electrode by melting or mechanical holding.

This amalgam 34 is produced by combining mercury and at least one selected from materials including bismuth (Bi), indium (In), lead (Pb), tin (Sn), zinc (Zn), cadmium (Cd) and silver (Ag). For example, in this embodiment, the amalgam 34 is made of a bismuth (Bi)-tin (Sn)-mercury (Hg), the inclusion of the mercury constituting substantially 4%.

Moreover, the amalgam 34 may be made of a bismuth (Bi)-indium (In)-mercury(Hg), a bismuth (Bi)-indium (In)-lead (Pb)-mercury (Hg), or lead (Pb)-mercury (Hg).

In the circular fluorescent lamp unit 31a, 31b or 31c shown in FIG. 8(B), an amalgam 35 is fixedly sealed up in the vicinity of a sealing portion provided at an end portion of the glass bulb 32, i.e., in the vicinity of the electrode disposed at the end portions thereof.

In the circular fluorescent lamp unit 31a, 31b or 31c shown in FIG. 8(C), an amalgam 36 is movably sealed up in the a glass bulb 32.

Incidentally, the remaining composing elements except for the circular fluorescent lamp units 31a, 31b or 31c of the lighting apparatus of the second embodiment are substantially the same as corresponding elements of the first embodiment, respectively. Thus, the description of such composing elements are omitted.

In FIG. 9, a curve "g" shows a characteristic of the circular fluorescent lamp unit 31a, 31b or 31c hermetically enclosing an amalgam, while a curve "h" shows a characteristic of the circular fluorescent lamp unit 31a or 31b hermetically enclosing a pure mercury. As obvious from this graph, the enclosure of the amalgam can provide a higher relative light intensity even if the ambient temperature is high, and the relative light intensity shows the peak value when the ambient temperature is substantially 30° to 40° C. Therefore, even if the ambient temperature of the lighting apparatus of this embodiment is high due to using the circular fluorescent lamp units 31a, 31b or 31c wherein the tube outer diameter is smaller, it is possible to keep the relative light intensity high and to light the circular fluorescent lamp units 31a, 31b or 31c effectively.

Figure 10:
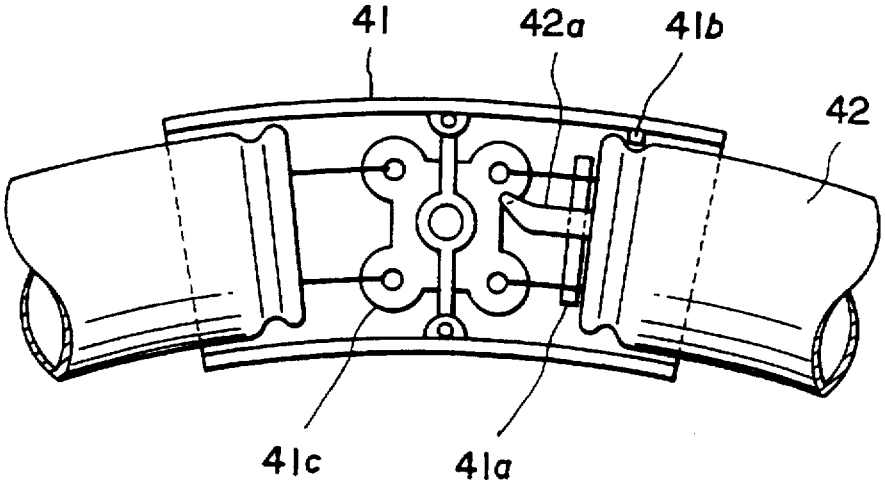
FIG. 10 is a partially enlarged and exploded front elevational view showing a circular fluorescent lamp unit according to a third embodiment of the present invention.
Figure 11:
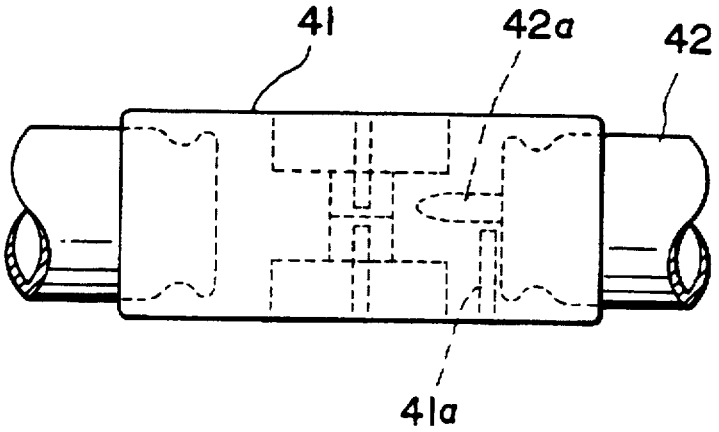
FIG. 11 is a partially enlarged side elevational view showing the circular fluorescent lamp unit according to the third embodiment of the present invention.

FIGS. 10 and 11 are partially enlarged exploded front elevational view and partially enlarged side elevational view both showing a third embodiment of the present invention.

In this embodiment, a base 41 is formed using a hollow resin-made member and substantially has a cylindrical configuration. The base 41 is divided into two sections with respect to a plane along its central longitudinal direction, and FIG. 10 illustrates an inside portion of one base section in which base pins (not shown) are provided outside. In the inner circumferential surface of the base 41, a rib 41a approaching or coming into contact with an end portion of a glass bulb 42 is provided so that the rib 41 projects in a direction perpendicular to the inner circumferential surface to have a height so as not to collide against a discharge pipe 42a.

Numeral 41b represents an engaging projection which engages with a small-diameter portion with a knot-like shape formed in the vicinity of the end portion of the glass bulb 42, whereby the glass bulb 42 is prevented from falling out.

A pin formation portion 41c is made in a central portion of the base 41, and the conductive portions of the base pins located in the pin formation portion 41c are connected to lead wires led out from both end portions of the glass bulb 42.

Moreover, the remaining composing elements except for the base @portion of the lighting apparatus of the third embodiment are substantially the same as corresponding elements of the first embodiment, respectively. Thus, the description of such composing elements are omitted.

According to this embodiment, for example, at the time of handling the circular fluorescent lamp units of this embodiment, the glass bulb 42 deforms in a direction that both its end portions approach each other to run over the engaging projection 41*b*, so that it is possible to prevent the damages due to the collision of the discharge pipe 42*a* against the pin formation portion 41*c*.

In the case that like the above-described embodiment the tube diameter becomes thinner as compared with that of the prior art, it was found that the glass bulb 42 becomes easily bent in the direction that both the end portions get close to each other. Thus, if the rib 41*a* is constructed as taken in this embodiment, the end portion of the glass bulb 42 becomes avoidable from a large movement toward the pin formation portion 41*c* side.

Although the rib 41*a* can be provided in only the side where the discharge 42*a* stands, it is also appropriate that it is provided in the other side.

Figure 12:
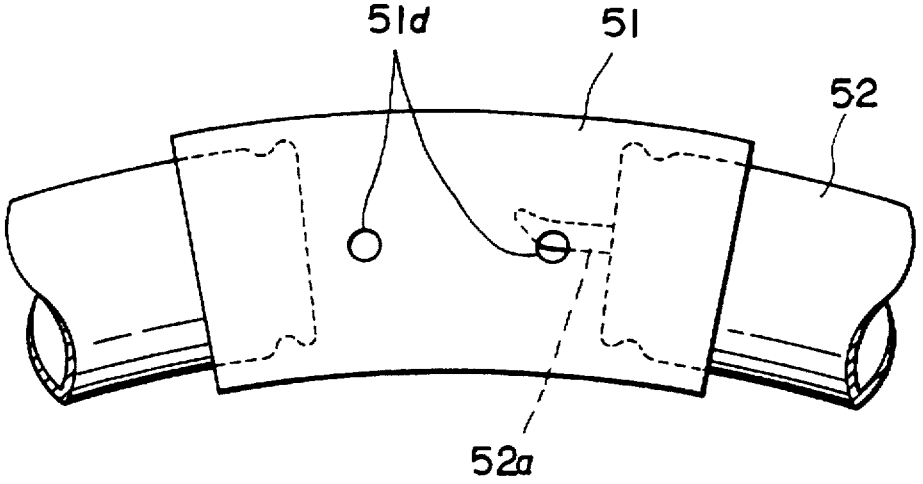
FIG. 12 is a partially enlarged front elevational view showing a forth embodiment of the present invention.

FIG. 12 is a partially enlarged front elevational view showing a fourth embodiment of the present invention. A ventilation hole 51*d* having a diameter of approximately 2 to 3 mm is bored in a base 51. At the projection position of this ventilation hole 51*d*, a discharge pipe 52*a* of a glass bulb 52 is made to protrude by approximately 1 mm. This ventilation hole 51*d* is not limited to configurations such as circle and slit. Further, although not shown, if a similar ventilation hole is also made in the opposite base 51 portion to provide a pair of ventilation holes being in opposed relation to each other, the cooling effect more improves.

Moreover, the remaining composing elements except for the base portion of the lighting apparatus of the fourth embodiment are substantially the same as corresponding elements of the first embodiment, respectively. Thus, the description of such composing elements are omitted.

According to this embodiment, the ventilation hole 51*d* effectively cools the discharge pipe 52*a* or the end portion of the glass bulb 52 to define the most cooled section, so that the temperature can be close to a desired temperature and the lamp efficiency more improves.

In these embodiments described above, the circular fluorescent lamp units different in lamp power from each other may concentrically be disposed in the different planes. However, the present invention is not limited the configuration. the circular fluorescent lamp units different in lamp power from each other may concentrically be disposed in the same plane. For example, a circular fluorescent lamp unit is developed which is integrally constructed such that one discharge path is formed in a state where two glass bulbs different in circular diameter from each other were coaxially disposed in the same plane. This integral type circular fluorescent lamp unit is made such that electrodes are fitted in one end sides of the two glass bulbs different in circular diameter and the other sides are hermetically sealed and a communication portion is provided so that a discharge path is defined to establish the communication therebetween.

In cases where circular fluorescent lamp units different in lamp power from each other are coaxially disposed in the same plane, its appearance approaches that of an integral type circular fluorescent lamp unit.

However, there is a possibility that this integral type fluorescent lamp unit has a low mechanical strength because of the connection through the communication portion. In addition, the formation of the communication portion inhibits the definition of a large gap between the ring inner diameter of the outside bulb and the circular outer diameter of the inside bulb. The small gap can hinder the effective utilization of the light output from the vicinity of the gap. Further, for mounting the circular fluorescent lamp unit on the lighting apparatus body, it is necessary to change the installation height of the circular bulb to match with the configuration of the apparatus body and the optical characteristic of the lighting apparatus.

Accordingly, the combination of a plurality of circular fluorescent lamp units, each comprising one circular bulb, different in circular diameter from each other is superior in strength aspect and an optical aspect, and in consequence, the degree of freedom for the mounting modes to the lighting apparatus increases.

It should be concluded, from what has been said above, that, in the circular fluorescent lamp units according to the present invention,the thickness of the circular fluorescent lamp unit of the present invention is more reduced than that of the prior circular fluorescent lamp unit and the thickness of the lighting apparatus using this circular fluorescent lamp unit is also more reduced than that of the prior lighting apparatus whereby the whole thickness reduction of the lighting apparatus having the circular lamp unit is realized while keeping the image of the prior apparatus in dimension. Therefore, the visual environments in a dwelling space can be comfotable in which the lighting apparatus of the present invention is set.

In addition, the lamp efficiency and the lighting output of circular fluorescent lamp unit of the present invention is improved than that of the prior circular fluorescent lamp unit while keeping the thickness thereof reduced.

While the present invention has been particularly shown and described with reference to the preferred embodiments thereof, it will be understood by those skilled in the art that the foregoing and other changes in form and details can be made therein without departing from the spirit and scope of the invention.

What is claimed is:

1. A circular fluorescent lamp unit comprising:

a circular glass bulb having a circular outer diameter set within a range of 285 to 310 mm or thereabout, a tube outer diameter set within a range of 15 to 18 mm or thereabout, and an inner surface onto which a fluorescent substance is applied;

a discharge medium including a rare gas and a mercury sealed up in the circular glass bulb; and a pair of electrode means fitted in both end portions of the circular glass bulb so as to be sealed therein whereby discharge occurs in the circular glass bulb by providing the pair of electrode means with a lamp power so that the circular glass bulb lights;

wherein said lamp power has a high frequency which is not less than 10 kHz and said lamp power is set within a range of 20 to 40 W or thereabout.

2. A circular fluorescent lamp unit according to claim 1, wherein said range of 20 to 40 W or thereabout of the light power includes a rated lamp power and a high-output characteristic lamp power, said rated lamp power is approximately 23 W and said high-output characteristics lamp power is approximately 38 W.

3. A circular fluorescent lamp unit according to claim 1, wherein said range of 20 to 40 W or thereabout of the light power includes a rated lamp power and a high-output characteristic lamp power, said rated lamp power is approximately 27 W and said high-output characteristics lamp power approximately 38 W.

4. A circular fluorescent lamp unit according to claim 1, wherein said fluorescent substance is of a type of emitting light with three wavelengths which are substantially 450 nm, substantially 540 nm and substantially 610 nm in peak wavelength.

5. A circular fluorescent lamp unit according to claim 1, wherein said circular glass bulb has a protective layer which is made of metal oxide fine particulates formed on the inner surface thereof, and said fluorescent substance is applied on the protective layer.

6. A circular fluorescent lamp unit comprising:

a circular glass bulb having a circular outer diameter set within a range of 365 to 390 mm or thereabout, a tube outer diameter set within a range of 15 to 18 mm or thereabout, and an inner surface onto which a fluorescent substance is applied;

a discharge medium including a rare gas and a mercury sealed up in the circular glass bulb; and a pair of electrode means fitted in both end portions of the circular glass bulb so as to be sealed therein whereby discharge occurs in the circular glass bulb by providing the pair of electrode means with a lamp power so that the circular glass bulb lights;

wherein said lamp power has a high frequency which is not less than 10 kHz and said lamp power is set within a range of 28 to 50 W or thereabout.

7. A circular fluorescent lamp unit according to claim 6, wherein said range of 28 to 50 W or thereabout of the light power includes a rated lamp power and a high-output characteristic lamp power, said rated lamp power is approximately 30 W and said high-output characteristics lamp power is approximately 48 W.

8. A circular fluorescent lamp unit according to claim 6, wherein said range of 28 to 50 W or thereabout of the light power includes a rated lamp power and a high-output characteristic lamp power, said rated lamp power is approximately 34 W and said high-output characteristics lamp power is approximately 48 W.

9. A circular fluorescent lamp unit according to claim 6, wherein said fluorescent substance is of a type of emitting light with three wavelengths which are substantially 450 nm, substantially 540 nm and substantially 610 nm in peak wavelength.

10. A circular fluorescent lamp unit according to claim 6, wherein said circular glass bulb has a protective layer which is made of metal oxide fine particulates formed on the inner surface thereof, and said fluorescent substance is applied on the protective layer.

11. A circular fluorescent lamp unit comprising:

a circular glass bulb having a circular outer diameter set within a range of 210 to 235 mm or thereabout, a tube outer diameter set within a range of 15 to 18 mm or thereabout, and an inner surface onto which a fluorescent substance is applied;

a discharge medium including a rare gas and a mercury sealed up in the circular glass bulb; and a pair of electrode means fitted in both end portions of the circular glass bulb so as to be sealed therein whereby discharge occurs in the circular glass bulb by providing the pair of electrode means with a lamp power so that the circular glass bulb lights;

wherein said lamp power has a high frequency which is not less than 10 kHz and said lamp power is set within a range of 17 to 30 W or thereabout.

12. A circular fluorescent lamp unit according to claim 11, wherein said range of 17 to 30 W or thereabout of the light power includes a rated lamp power and a high-output characteristic lamp power, said rated lamp power is approximately 17 W and said high-output characteristics lamp power approximately 28 W.

13. A circular fluorescent lamp unit according to claim 11, wherein said range of 17 to 30 W or thereabout of the light power includes a rated lamp power and a high-output characteristic lamp power, said rated lamp power is approximately 20 W and said high-output characteristics lamp power approximately 28 W.

14. A circular fluorescent lamp unit according to claim 11, wherein said fluorescent substance is of a type of emitting light with three wavelengths which are substantially 450 nm, substantially 540 nm and substantially 610 nm in peak wavelength.

15. A circular fluorescent lamp unit according to claim 11, wherein said circular glass bulb has a protective layer which is made of metal oxide fine particulates formed on the inner surface thereof, and said fluorescent substance is applied on the protective layer.

16. A lighting apparatus comprising:

a lighting body; and at least one circular fluorescent lamp unit disposed in the lighting body, wherein said at least one circular fluorescent lamp unit comprises a circular glass bulb disposed in the lighting body having a circular outer diameter set within substantially one of ranges of 285 to 310 mm, 365 to 390 mm and 210 to 235 mm, a tube outer diameter of 15 to 18 mm or thereabout and an inner surface onto which a fluorescent substance is applied, a discharge medium including a rare gas and a mercury sealed up in the circular glass bulb, and a pair of electrode means fitted in both end portions of the circular glass bulb so as to be sealed therein; and a lighting circuit for supplying the circular glass bulb of the at least one circular fluorescent lamp unit through the pair of electrode means thereof with a lamp power having a high frequency which is not less than 10 kHz, said lamp power being set within a range of 17 to 50 W or thereabout thereby occurring discharge in the circular glass bulb so that the circular glass bulb lights.

17. A lighting apparatus according to claim 16, wherein said lighting apparatus comprises at least two circular fluorescent lamp units, said at least two circular fluorescent lamp units being concentrically arranged in different plane.

18. A lighting apparatus according to claim 17, wherein said lighting apparatus has a shading portion attached to the lighting body so that the at least two circular fluorescent lamp units are covered with the shading portion.

19. A lighting apparatus comprising:

a lighting body;

at least one circular fluorescent lamp unit according to claim 16 disposed in the lighting body, wherein said range of 20 to 40 W or thereabout of the light power includes a rated lamp power and a high-output characteristic lamp power; and a lighting circuit for supplying the circular glass bulb of the at least one circular fluorescent lamp unit through the pair of electrode means thereof with a lamp power having a high frequency which is not less than 10 kHz, and for controlling the supplying lamp power to the circular glass bulb of the at least one circular fluorescent lamp unit in that the supplying lamp power is switchable between the rated lamp power and the high-output characteristics lamp power.

* * * * *

UNITED STATES PATENT AND TRADEMARK OFFICE

CERTIFICATE OF CORRECTION

PATENT NO. : 5,796,210
DATED : August 18, 1998
INVENTOR(S) : Yuichi Sakakibara, et al.

It is certified that error appears in the above-identified patent and that said Letters Patent is hereby corrected as shown below:

In col. 1, at line 40, before "whole" insert --the--.

In col. 6, at line 11, change "unit;." to --unit;--.

In col. 8, line 35, delete "each other".

In col. 15, at line 63, change "a discharge pipe 32a" to -an exhaust pipe 32a--.

In col. 16, at lines 1-2, change "discharge pipe 32a" to --exhaust pipe 32a--;

In col. 16, at line 56, change "a discharge pipe" to --an exhaust pipe--.

In col. 17, at line 2, change "@portion" to --portion--;

In col. 17, at line 11, change "discharge pipe 42a" to --exhaust pipe 42a--.

In col. 17, at line 22, change "discharge 42a" to --exhaust pipe 42a--;

In col. 17, at line 28, change "a discharge pipe 52a" to -an exhaust pipe 52a--.

In col. 17, at line 41, (

Signed and Sealed this

Thirty-first Day of October, 2000

*Attest:*

Q. TODD DICKINSON

*Attesting Officer*

*Director of Patents and Trademarks*